US009771671B2

(12) United States Patent
König

(10) Patent No.: US 9,771,671 B2
(45) Date of Patent: Sep. 26, 2017

(54) DOUBLE-FOLDING DRAFTING UNIT

(71) Applicant: Reinhard König, Ettlingen (DE)

(72) Inventor: Reinhard König, Ettlingen (DE)

(73) Assignee: Reinhard König, Ettlingen (DE)

( * ) Notice: Subject to any disclaimer, the term of this patent is extended or adjusted under 35 U.S.C. 154(b) by 304 days.

(21) Appl. No.: 14/646,759

(22) PCT Filed: Sep. 23, 2013

(86) PCT No.: PCT/EP2013/002849
§ 371 (c)(1),
(2) Date: May 22, 2015

(87) PCT Pub. No.: WO2014/044404
PCT Pub. Date: Mar. 27, 2014

(65) Prior Publication Data

US 2015/0292123 A1 Oct. 15, 2015

(30) Foreign Application Priority Data

Sep. 24, 2012 (DE) ..... 10 2012 018 772

(51) Int. Cl.
*D01H 5/82* (2006.01)
*D01H 5/70* (2006.01)
*D04B 9/14* (2006.01)

(52) U.S. Cl.
CPC ..... *D01H 5/82* (2013.01); *D01H 5/70* (2013.01); *D04B 9/14* (2013.01)

(58) Field of Classification Search
CPC .. D01H 5/22; D01H 5/26; D01H 5/70; D01H 5/82; D04B 9/14
See application file for complete search history.

(56) References Cited

U.S. PATENT DOCUMENTS 3,341,901 A * 9/1967 Kitamura ..... D01H 5/26 19/244
3,600,759 A * 8/1971 Grishin ..... D01H 5/88 19/255

(Continued)

FOREIGN PATENT DOCUMENTS

DE 10 2006 006 502 A1 8/2007
WO WO 2013/041220 A1 3/2013

OTHER PUBLICATIONS

International Search Report dated Jan. 3, 2014 issued in PCT/EP2013/002849.
Written Opinion dated Mar. 24, 2015 issued in PCT/EP2013/002849.

*Primary Examiner* — Shaun R Hurley
(74) *Attorney, Agent, or Firm* — Kilpatrick Townsend & Stockton LLP

(57) ABSTRACT

The invention relates to a double-folding drafting unit, comprising five pairs of rollers, a first, a second, a fourth and a fifth pair of rollers having essentially an identical orientation of the respective axes of the rollers, and a third pair of rollers, which is positioned between the second and the fourth pair of rollers, having an axial direction which is oriented perpendicularly to the axial direction of the other pairs of rollers, an apron being guided in each case around each roller of the first and third pair of rollers and at least one reversing rail assigned to the respective roller, and an apron being guided around each roller of the fourth pair of rollers and around a reversing rail in front of and a reversing rail behind the respective roller. The invention relates, furthermore, to a spin-knitting machine comprising at least two double-folding drafting units.

14 Claims, 7 Drawing Sheets

(56) References Cited

U.S. PATENT DOCUMENTS

| | | | | | |
|---|---|---|---|---|---|
| 4,112,548 | A * | 9/1978 | Sauvage | D01G 1/08 | 19/243 |
| 4,845,813 | A * | 7/1989 | Salaun, Jr. | D01H 5/22 | 19/258 |
| 5,010,624 | A * | 4/1991 | Stahlecker | D01H 5/22 | 19/258 |
| 5,459,902 | A * | 10/1995 | Hino | D01G 99/00 | 19/236 |
| 5,600,872 | A * | 2/1997 | Artzt | D01H 1/025 | 19/150 |
| 7,926,306 | B2 * | 4/2011 | Koenig | D01H 1/00 | 66/9 B |
| 2006/0010653 | A1 * | 1/2006 | Duda | D01G 15/46 | 19/98 |
| 2009/0064719 | A1 * | 3/2009 | Koenig | D01H 1/00 | 66/17 |

* cited by examiner

DOUBLE-FOLDING DRAFTING UNIT

CROSS-REFERENCE TO RELATED APPLICATIONS

This application is a U.S. national phase under 35 U.S.C. 371 of International Patent Application No. PCT/EP2013/002849, entitled "Double Folding Drawframe", filed Sep. 23, 2013, which claims the benefit of German Application No. 102012018772.6 the entire contents and disclosures of which are incorporated herein by reference.

FIELD OF THE INVENTION

The invention relates to a double-folding drafting unit, such as is used, for example, in spin-knitting methods or other spinning methods.

BACKGROUND

Folding drafting units are used in order to draw fibres of a sliver into a fine ribbon before spinning. This drawing of the sliver is also designated as drafting. Drafting units used at the present time are, for example, four-roller drafting units which have two roller groups standing perpendicularly to one another. A third pair of rollers carries aprons which fold the fibre material emerging from the second pair of rollers and deliver it in this state to a fourth pair of rollers, by which the fibre material is drafted to final fineness. Such a drafting unit is known, for example, from WO-A 2013/041220.

In folding drafting units used at the present time, the sliver can acquire a draft of 150 to 400 times. The disadvantage, however, is that, in the case of very high drafts, the unevenness of the fibre material emerging from the drafting unit increases, and this may lead to unacceptable yarn unevenness. In contrast to this, in the case of low drafts upstream of the folding zone, compacting by folding is not optimal, and this may cause the fibre material to expand in the nip region of the last pair of rollers, consequently impeding the subsequent spinning process.

The object of the present invention was, therefore, to provide a folding drafting unit, by means of which, even in the case of high drafts, maximum evenness and a minimum exit width of the emerging fibre material can be achieved.

SUMMARY

This object is achieved by means of a double folding drafting unit, comprising five pairs of rollers,

- a first, a second, a fourth and a fifth pair of rollers having essentially an identical orientation of the respective axes of the rollers, and a third pair of rollers, which is positioned between the second and the fourth pair of rollers, having an axial direction which is oriented perpendicularly to the axial direction of the other pairs of rollers,
- an apron being guided in each case around each roller of the third pair of rollers and at least one reversing rail assigned to the respective roller, and
- an apron being guided around each roller of the fourth pair of rollers and around a reversing rail in front of and a reversing rail behind the respective roller.

By means of the folding drafting unit according to the invention with five pairs of rollers, also designated as a five-roller double-folding drafting unit, it is possible to increase the quality of sheet-like textile structures which are generated from the fibres leaving the drafting unit. In particular, the folding drafting unit according to the invention is suitable for increasing the quality of sheet-like textile structures which are generated in spin-knitting machines.

In the folding drafting unit formed according to the invention, preferably in each case one roller of a pair of rollers is driven. The second roller of the pair of rollers is pressed against the driven roller of the pair of rollers and therefore corotates. Alternatively, it is also possible to drive both rollers of a pair of rollers. It is preferable, however, to drive only one roller of a pair of rollers.

In a preferred embodiment, aprons are not only guided around the rollers of the third and fourth pair of rollers and the reversing rails assigned to the respectively rollers, but also around each roller of the first pair of rollers and at least one reversing rail assigned to the respective roller.

The aprons are preferably made from polyurethane or silicone rubber.

Four drafting zones are formed as a result of the arrangement of the pairs of rollers. Thus, in each case two adjacent pairs of rollers form a drafting zone, a first drafting zone between the first and the second pair of rollers having a draft which is comparable to the draft of a roving machine, a second drafting zone between the second and the third pair of rollers and a third drafting zone between the third and the fourth pair of rollers having in each case tensioning drafts, and a main draft being implemented in a fourth drafting zone between the fourth and the fifth pair of rollers.

On account of the rotated orientation of the axial position of the third pair of rollers, the second and the third drafting zone at the same time also constitute folding zones. The sliver is folded a first time in the second drafting zone and a second time in the third drafting zone. As a result of this double folding, the width of the sliver is reduced to a fraction of the original width. The advantage of this is that maximum possible evenness of the width of the sliver can be achieved even in the case of high drafts in the range of 1.50 to 400 times.

In one embodiment of the invention, the corotating rollers of the first, second and fourth pair of rollers lie on a first pressure arm and a second pressure arm carries the corotating roller of the fifth pair of rollers. Particularly when the folding drafting unit is used in a spin-knitting machine, the first pressure arm is preferably arranged in suspension. The first pressure arm may, for example, be loadable pneumatically in order thereby to implement a sufficiently high pressure force of the corotating rollers upon the driven rollers of the respective pair of rollers. Since faults on account of the high speed of the rollers of the fifth pair of rollers are most likely to occur between the fifth pair of rollers and the spinneret, the mounting of the corotating roller of the fifth pair of rollers on a separate pressure arm affords the possibility that, in order to eliminate the fault, only this pair of rollers has to be opened and the rest can remain closed. It is thereby possible to attend to the fault and eliminate it in a simple way.

Furthermore, it is preferable if the corotating roller of the third pair of rollers is connected to a torsion shaft via a lever arm, the torsion shaft generating the necessary applied pressure moment. For this purpose, the torsion shaft is preferably loaded pneumatically. This set-up makes it possible to easily change the aprons running around the rollers of the third pair of rollers, since the aprons can be stripped off or slipped on the rollers without any further outlay in terms of assembly.

In a further preferred embodiment of the folding drafting unit according to the invention, the aprons of the fourth pair of rollers have a different thickness, the apron which runs around the driving roller of the fourth pair of rollers having a greater thickness than the apron running around the corotating roller of the fourth pair of rollers.

The selected thickness of the apron running around the corotating roller of the fourth pair of rollers is in this case preferably as small as possible. In aprons used at the present time in drafting units, the minimum thickness usually amounts to 0.3 to 0.7 mm. However, the thickness is in this case also dependent on the material from which the aprons are made.

The apron surrounding the driving roller of the fourth pair of rollers has a thickness which corresponds to the thickness of aprons normally used in drafting units and which is conventionally greater than 1 mm.

It is especially preferable if, in the apron running around the driving roller of the fourth pair of rollers, a depression pointing in the running direction is formed in the surface pointing towards the fibre stream. Preferably, the depression is formed centrally in the apron running around the driving roller of the fourth pair of rollers. The depression imitates the nature of a pulling drafting unit, as it is known, thus stabilizing the drafting operation, particularly in the case of drafts of more than 200 times. The depression is preferably configured in the form of a rectangular channel, wherein, depending on the slivers used, a suitable channel has, for example, a width in the range of 5 to 10 mm, for example of 5 mm, and a depth in the range of 0.1 to 0.25 mm, for example of 0.25 mm.

In order to drive the rollers of the pairs of rollers, it is advantageous if the driven rollers of the second, third and fourth pair of rollers are coupled to a common gear, the gear being assigned a motor or a drive train. The driven rollers of the first and of the fifth pair of rollers are in this case driven in each case by a separate motor or drive train. The drive of the driven rollers of the first and of the fifth pair of rollers by a separate motor or drive train is advantageous particularly because of the different rotational speeds of the rollers in order to obtain the desired draft. In order to obtain the desired main draft in the fourth drafting zone, the rollers of the fifth pair of rollers must rotate at a multiple of the rotational speed of the preceding rollers.

The folding drafting unit according to the invention is suitable particularly for use in spin-knitting machines. In this case, a plurality of folding drafting units are arranged around the spin-knitting machine. The spin-knitting machine may in this case be set up such as is known from the prior art. In a preferred embodiment, the folding drafting units are combined into groups which may also be designated as drafting unit groups. The drafting unit groups in this case have drives which act either upon the driven rollers of only one drafting unit, upon the driven rollers of a plurality of crafting units or upon the driven rollers of all the drafting units of a drafting unit group. If the driven rollers of a plurality of drafting units are driven by a drive, it is advantageous in each case to drive the driven rollers of corresponding pairs of rollers, for example in each case the driven rollers of the first pair of rollers, by a drive.

In one embodiment, it is possible, for example, that the drive of a plurality of driven rollers of in each case corresponding pairs of rollers of the double-folding drafting units comprises two groups which are connected to one another by means of toothed belts, a gear stage coupling the two groups.

In one embodiment, the drive of the fifth pair of rollers comprises a reluctance drive and a servo drive. In this case, it is possible to provide each driven roller of the fifth pair of rollers or all the driven rollers of a section with a dedicated drive. Furthermore, it is possible and especially preferable to provide all the driven rollers of the fifth pairs of rollers of all the drafting units of the spin-knitting machine with a drive, in this case the drive torque being transmitted via suitable belts and gears.

In order to start up or run down the spin-knitting machine, it is especially preferable, when the spin-knitting machine is being started up, to drive the driving roller of the fifth pair of rollers initially by means of the servo drive, in which case the reluctance drive can corotate or is cut in during acceleration, and, after the production rotational speed is reached, to switch off the servo drive so that the drive of the driving roller of the fifth pair of rollers takes place via the reluctance drive, and, when the spin-knitting machine is being run down, initially to cut in the servo drive, in which case, with reduction in the production rotational speed, the drive of the driving roller of the fifth pair of rollers is assumed by the servo drive, and to switch off the reluctance drive. On account of the even running of the reluctance drive, an especially even drawing of the fibre material can thereby be achieved. However, since the slow increase and decrease in the rotational speed of the spin-knitting machine respectively during start-up and run-down are not suitable for accelerating or braking the reluctance motor correspondingly, the servomotor is used for start-up and run-down.

Exemplary embodiments of the invention are illustrated in the figures and are explained in more detail in the following description.

DESCRIPTION

Figure 1A:
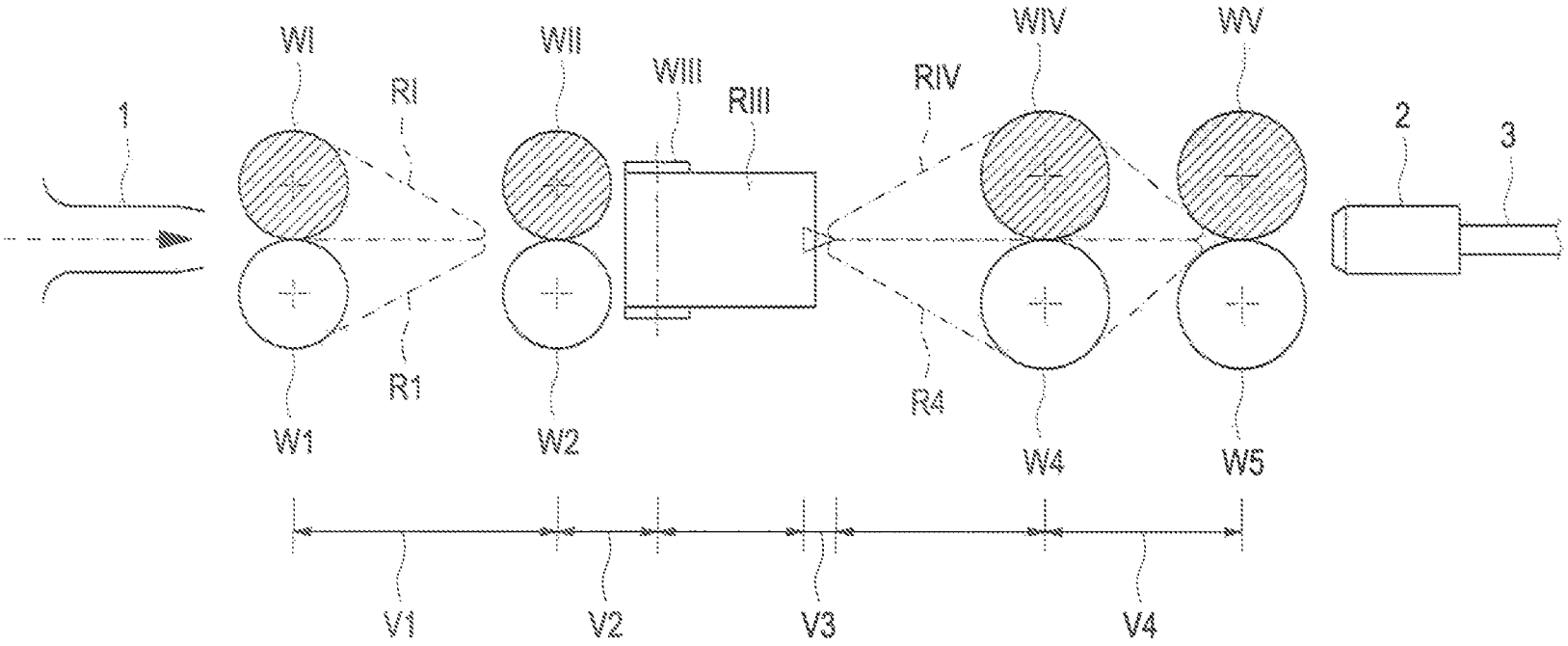
FIG. 1*a* shows a side view of a double-folding drafting unit designed according to the invention.
Figure 1B:
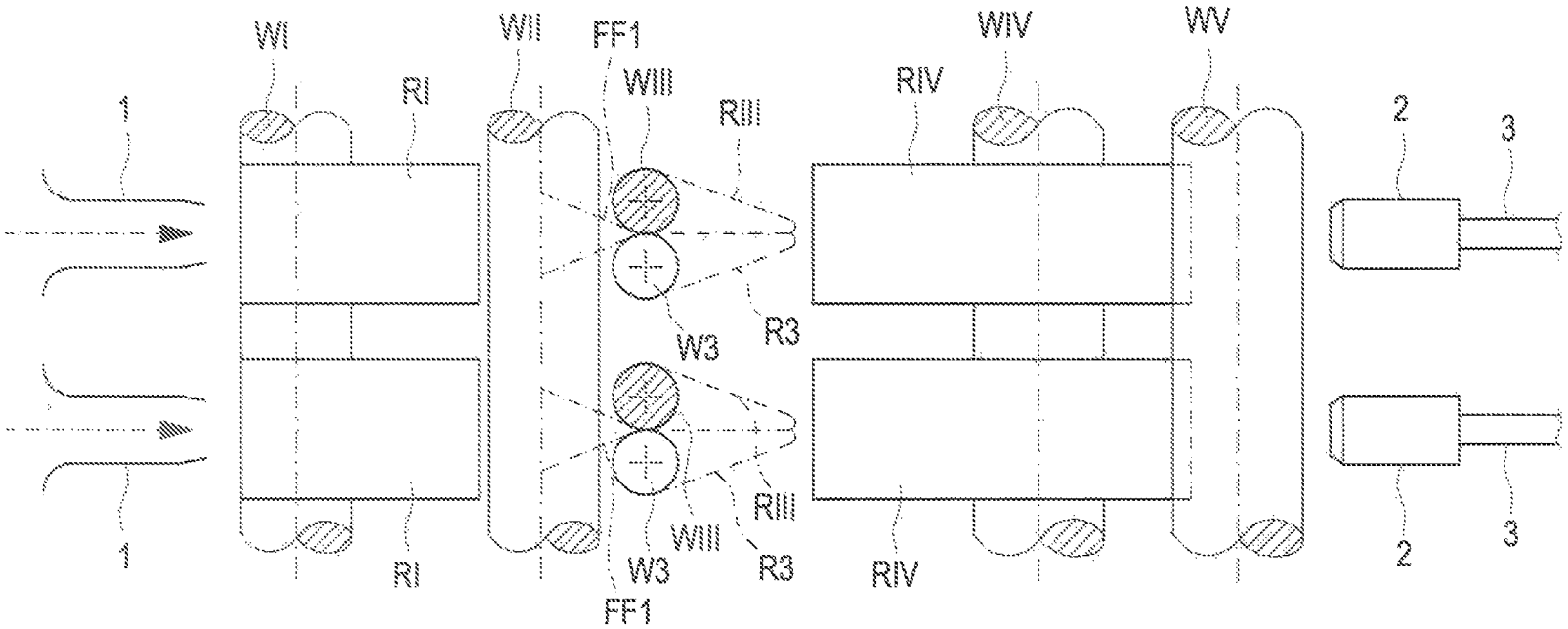
FIG. 1*b* shows a top view of a double-folding drafting unit according to FIG. 1*a*.

FIGS. 1*a* and 1*b* illustrate a double-folding drafting unit designed according to the invention in a side view (FIG. 1*a*) and in a top view (FIG. 1*b*). A double-folding drafting unit, such as may be used, for example, in spin-knitting machines or else in spinning machines for yarn production, comprises a fibre guide tube 1, which is also designated as a trocar. The fibre guide tube 1 lies in this case in front of a first pair of rollers WI/W1 with a driven roller WI and with a corotating roller W1. Aprons R1, RI are guided around the rollers WI, W1 of the first pair of rollers and a pair of reversing rails, not illustrated in FIG. 1, assigned to the first pair of rollers WI/W1. A drawframe sliver delivered via the fibre guide tube 1 is guided between the aprons RI, R1. The fibre guide tube 1 is in this case preferably designed such that the drawframe sliver is distributed over the entire width of the rollers WI, W1 of the first pair of rollers. Material folding in the following folding zones is thereby improved.

The first pair of rollers WI/W1 equipped with the aprons R1, RI is followed by a second pair of rollers WII/W2 which likewise comprises a driven roller WIT and a corotating roller W2. The first pair of rollers WI/W1 and the second pair of rollers WII/W2 form a first drafting zone V1. The drafting of the drawframe sliver delivered to the first pair of rollers WI/W1 in this case normally takes place by means of a higher circumferential speed of the rollers WI, W1 of the second pair of rollers WII/W2. The silver unevenness which increases during drafting operations is reduced to what is unavoidable by the aprons RI, R1 around the first pair of rollers WI/W1 in the first drafting zone V1.

The second pair of rollers WII/W2 is followed by a third pair of rollers WIII/W3. According to the invention, the third pair of rollers WIII/W3, which likewise comprises a driven roller WIII and a corotating roller W3, is rotated with respect to the second pair of rollers WII/W2. The third pair of rollers WIII/W3 is equipped with aprons which in each case run around a roller WIII, W3 of the third pair of rollers and a reversing rail, not illustrated here.

The second pair of rollers WII/W2 and the third pair of rollers WIII/W3 delimit a second drafting zone V2. The second drafting zone V2 has a tensioning draft. As a result of the rotated arrangement of the third pair of rollers WIII/W3 with respect to the second pair of rollers WII/W2, the second drafting zone V2 also acts at the same time as a folding zone in which the width of the fibre stream formed by the drawframe sliver is markedly reduced.

Thus, for example, a reduction in the second drafting zone V2 makes it possible to implement a reduction in the width of the fibre stream by a factor 3 to 4.

The third pair of rollers WIII/W3 is followed by a fourth pair of rollers WIV/W4 with a driven roller WIV and with a corotating roller W4. The fourth pair of rollers, in turn, is rotated with respect to the third pair of rollers WIII/W3, according to the invention the axial direction of the rollers WIV/W4 of the fourth pair of rollers WIV/W4 corresponding to the axial direction of the first and second pair of rollers WI/W1, WII/W2. As a result of the rotation, a second folding zone occurs between the third pair of rollers WIII/W3 and the fourth pair of rollers WIV/W4 and also at the same time constitutes a third drafting zone V3. The fourth pair of rollers WIV/W4 likewise carries aprons RIV, R4, and, in contrast to the aprons R1, RI, RII, R2 of the first and second pair of rollers WI/W1, WII/W2, the aprons RIV, R4 run in this case around two reversing rails, one reversing rail being arranged in front of the respective roller WIV, W4 and one reversing rail being arranged behind the roller WIV, W4.

In a third drafting zone V3, a further reduction in the width of the sliver by a factor in the range of 1.5 to 2.5 is achieved by folding. Thus, it is possible, for example, to obtain a reduction in the width of the sliver from originally 20 mm to 4 mm in the first three drafting zones V1, V2, V3.

The fourth pair of rollers WIV/W4 is followed by a fifth pair of rollers WV/W5, likewise with a driven roller WV and with a corotating roller W5. A fourth drafting zone V4 is located between the fourth pair of rollers WIV/W4 and the fifth pair of rollers WV/W5, the fourth drafting zone V4 being the main drafting zone in which the fibre material is drawn to final fineness.

The folding drafting unit is preferably operated such that the first drafting zone V1 has a draft which corresponds to the draft of a commercially available roving machine. The draft of the fourth drafting zone V4 preferably corresponds to that of a fine spinning machine, for example a ring spinning machine.

By virtue of the rotated arrangement of the third pair of rollers WIII/W3 with respect to the second pair of rollers WII/W2 and the fourth pair of rollers WIV/W4 and by virtue of the folding zones associated therewith, the folding figures FF1 and FF2 occurring in the respective folding zones show a pronounced difference in the size of their area. This results in the desired sufficient compacting of the fibre stream running into the fifth pair of rollers WV/W5.

The fifth pair of rollers WV/W5 is followed by a spinneret 2 with a spinning tube 3, the spinning tube 3 ending, for example, at a knitting head of a spin-knitting machine, not illustrated here.

Figure 2:
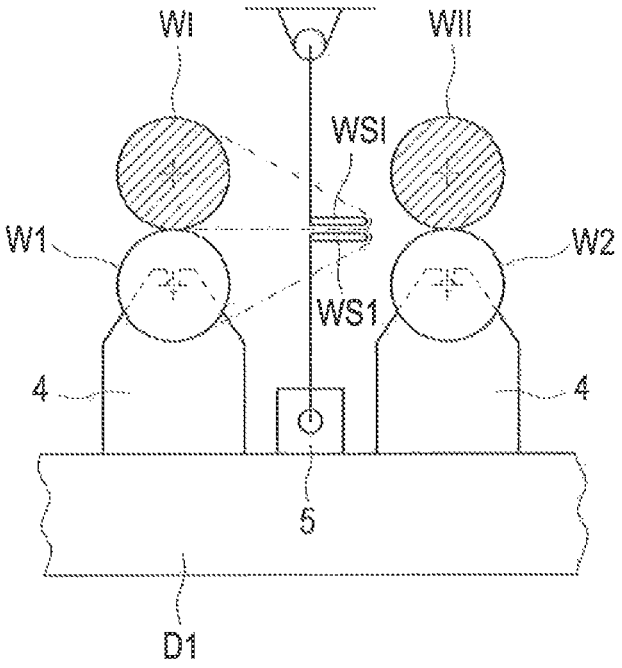
FIG. 2 shows a side view of a detail of a double-folding drafting unit, the said detail showing the first and the second pair of rollers.

FIG. 2 shows the first and second pair of rollers of a double-folding drafting unit in a side view.

In a preferred embodiment, the corotating rollers W1, W2 of the first pair of rollers WI/W1 and of the second pair of rollers WII/W2 are mounted jointly on a first pressure arm D1. In addition, it is advantageous also to connect the corotating roller W4 of the fourth pair of rollers WIV/W4 to the first pressure arm D1. This can be gathered, for example, from the detail shown in FIG. 3. The corotating rollers W1, W2 and W4 are thus in this case each mounted, for example, in a bearing bock 4 which is connected to the first pressure arm D1.

When the double-folding drafting unit is used in a spin-knitting machine, it is preferable to arrange the pressure arm D1 in suspension. A suitable pressure arm D1 is in this case any conventional pressure arm which can be used for drafting units. Pressure arms of this type are obtainable, for example, via the company Saurer Texparts GmbH.

Since the conditions of space are restricted in many areas of use, particularly in use in spin-knitting machine, a narrow division is preferably selected. Such a narrow division preferably lies in the range of 40 to 60 mm.

If it is not possible to use commercially available apron cages because of the narrow division, it is possible to arrange a receptacle 5 for a reversing rail. WS1 on the first pressure arm D1 between the bearing blocks 4. The aprons R1 run around the reversing rail WS1 and the corotating roller W1 of the first pair of rollers WI/W1. Arranged opposite the reversing rail WS1 is a reversing rail WSI, around which the apron RI runs. The reversing rails WSI and WS1 are arranged such that the aprons run parallel to one another in the region between the opposite rollers W1, WI and the opposite reversing rails WSI, WS1. As a result, the area of contact with the sliver enlarged, and the sliver delivered by the fibre guide tune is picked up more effectively by the folding drafting unit. A predraft in the first drafting zone V1 is achieved in that the circumferential speed of the rollers WII, W2 of the second pair of rollers WII/W2 is higher than the circumferential speed of the rollers WI, W1 of the first pair of rollers WI/W1.

In order to increase the mountability and adjustability of the reversing rail WSI, WS1, these are preferably pivotable, in particular about an axis of rotation oriented parallel to the axis of the rollers WI, W1.

Figure 3:
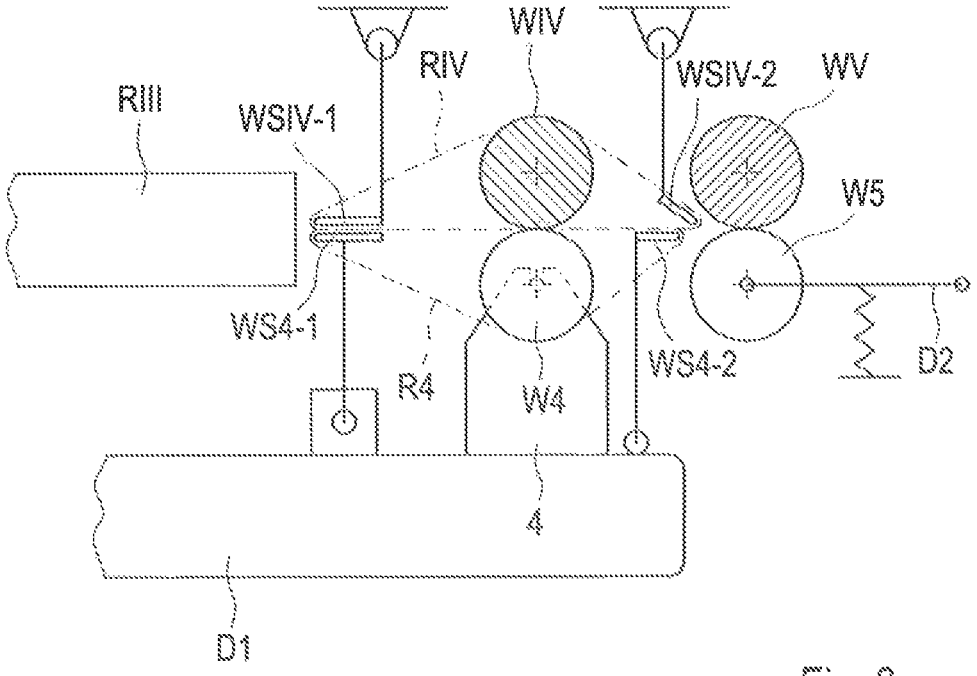
FIG. 3 shows a side view of a detail of a double-folding drafting unit, the said detail showing the fourth and the fifth pair of rollers.

FIG. 3 illustrates a detail of a double-folding drafting unit in a side view, the said detail showing the fourth and fifth pair of rollers.

As already described above, the corotating roller W4 of the fourth pair of rollers WIV/W4 is preferably likewise mounted in a bearing block 4 on the first pressure arm D1. Aprons RIV, R4 are in each case guided around the rollers WIV, W4 of the fourth pair of rollers WIV/W4 and around reversing rails WSIV-1, WSIV-2, WS4-1, WS4-2, the aprons RIV, R4 being guided, on the one hand, around reversing rails WSIV-1, WSIV-2 and the roller WIV and, on the other hand, around the reversing rails WS4-1, WS4-2 and the roller W4. In the running direction of the sliver, the reversing rails WSIV-1 and WS4-1 are located in front of the fourth pair of rollers WIV/W4 and the reversing rails WSIV-2 and WS4-2 are located behind the fourth pair of rollers WIV/W4. In the same way as the reversing rails WSI, WS1 assigned to the first pair of rollers WI/W1, of the reversing rails WSIV-1, WSIV-2, WS4-1 and WS4-2 which are assigned to the fourth pair of rollers WIV/W4 preferably at least one reversing rail, per apron R4, RIV in each case, is pivotable, in particular about an axis of rotation running parallel to the rollers WIV, W4 of the fourth pair of rollers WIV/W4, in order to make mountability and adjustability easier.

In order to obtain a parallel orientation of the roller and reversing rail, commercially available apron cages are mounted conventionally on the axis of the corotating roller. Since the aprons R4, RIV of the fourth pair of rollers WIV/W4 run via two reversing rails WS4-1, WS4-2 or WSIV-1, WSIV-2, it is expedient for reasons of space, particularly in the case of the aprons R4, RIV of the fourth pair of rollers WIV/W4, to mount at least one of the reversing rails WS4-1, WS4-2 of the apron R4 running around the driving roller W4 and at least one of the reversing rails WSIV-1, WSIV-2 of the apron RIV running around the corotating roller WIV not on the axis of the corresponding roller W4, WIV, but instead separately on the pressure arm D1. It is especially preferable if the reversing rails WS4-1 and WS4-2 assigned to the corotating roller W4 are mounted adjustably on the first pressure arm D1. By virtue of this arrangement, it is possible to adjust the apron tension of the apron R4 running around the corotating roller W4 and the assigned reversing rails WS4-1 and WS4-2.

As can be gathered further from FIG. 3, the corotating roller W5 of the fifth pair of rollers WV/W5 is mounted on a second pressure arm D2. Mounting the corotating roller W5 on the second pressure arm D2 has the advantage that the corotating roller W5 can be adjusted independently of the rollers W1, W2 and W4 which are mounted on the first pressure arm D1. This is expedient particularly because of the desired draft in the fourth drafting zone V4 and the consequently required circumferential speed of the fifth pair of rollers WV/W5. Moreover, the pressure force of the corotating roller W5 against the driven roller WV can consequently be set individually in a simple way, so that the sliver is also transported and drawn reliably.

When the folding drafting unit is in operation, the sliver guided between the aprons R3, RIII of the third pair of rollers WIII/W3 is conducted into the gap between the aprons RIV, R4 of the fourth pair of rollers WIV/W, and the sliver is folded further because of the orientation, rotated with respect to the orientation of the fourth pair of rollers WIV/W4, of the third pair of rollers WIII/W3 and therefore also of the aprons RIII, R3 assigned to the third pair of rollers WIII/W3. Transport is neutral as far as the nip line between the rollers WIV, W4 of the fourth pair of rollers WIV/W4, and, after the nip line is left, the main draft in the fourth drafting zone 4 to the desired fineness commences.

Figure 4A:
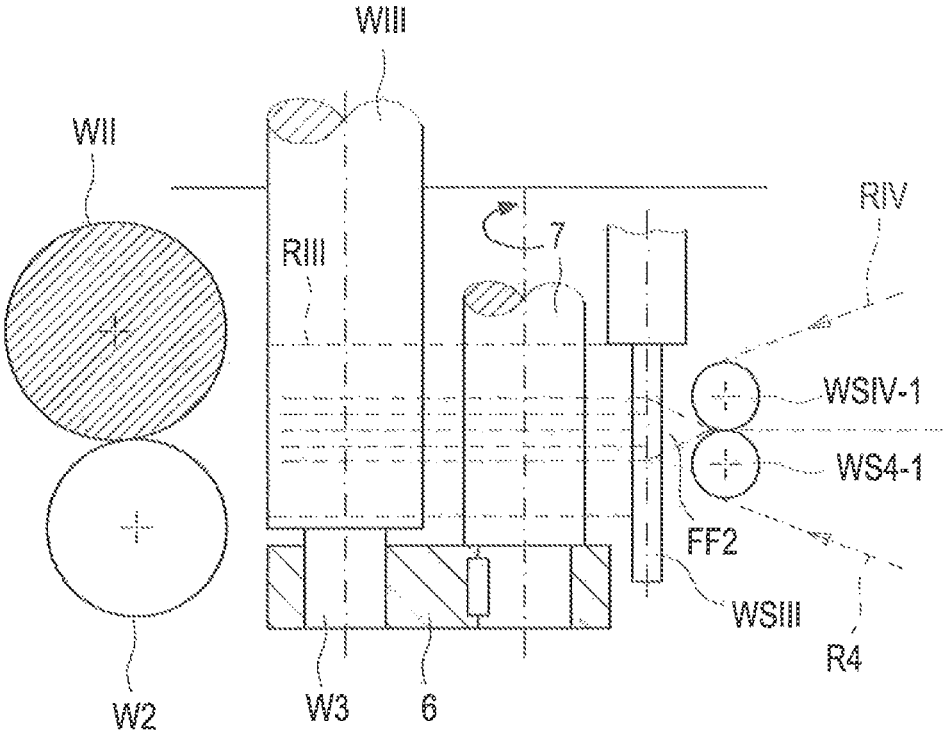
FIG. 4*a* shows a side view of a detail of the double-folding drafting unit, the said detail showing the second and the third drafting zone.
Figure 4B:
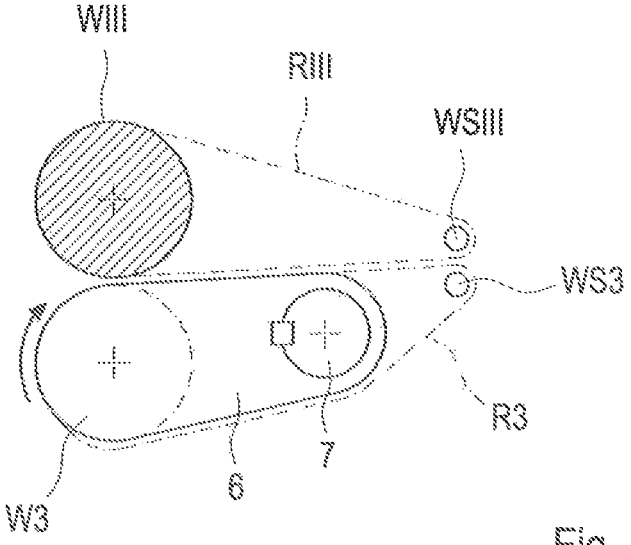
FIG. 4*b* shows a bottom view of the detail illustrated in FIG. 4*a*.

FIGS. 4*a* and 4*b* illustrate a detail of the double-folding drafting unit in a side view (FIG. 4*a*) and in a bottom view (FIG. 4*b*), the said detail showing the second and third drafting zone. The driven roller WIII of the third pair of rollers WIII/W3 is preferably mounted in the housing and drives the corotating roller W3 of the third pair of rollers WIII/W3. An apron RIII runs around the driven roller WIII and a reversing rail WSIII and an apron R3 runs around the corotating roller W3 and a reversing rail WS3.

In the embodiment illustrated here, the corotating roller WIII of the third pair of rollers WIII/W3 is connected to a torsion shaft 7 via a lever arm 6. The torsion shaft 7 generates the necessary applied pressure moment and is preferably loaded pneumatically. This type of construction makes it possible to change the aprons RIII, R3 easily, since these can be stripped off and slipped on without any further outlay in terms of assembly.

When folding drafting units are used in spin-knitting machines, a plurality of folding drafting units which are driven next to one another are employed. In this case, it is especially advantageous to connect a plurality of folding drafting units in each case to form a section, a plurality of sections being grouped around a knitting device. A section usually comprises, for example, 8 or 12 workstations. In the case of 6 sections, a number of systems of 48 or 72 systems is consequently obtained. Advantageously, the driven rollers of all the corresponding pairs of rollers of the folding drafting units of a section are driven by one drive. This is illustrated in FIG. 5, for example, for the pairs of rollers WIII/W3.

Figure 5:
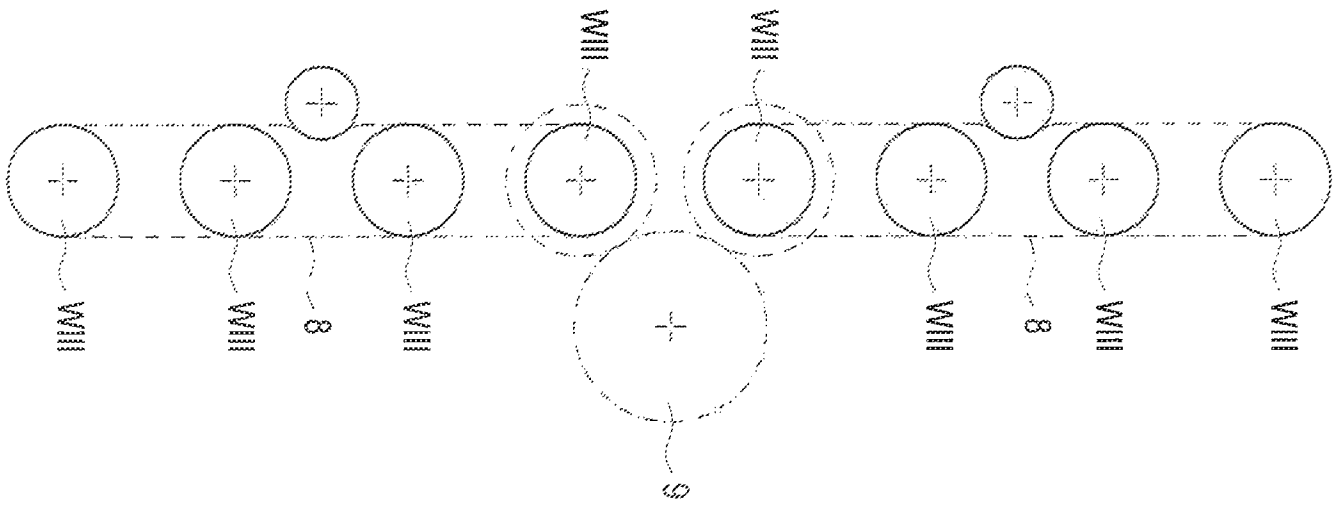
FIG. 5 shows a drive concept for driven rollers, combined into groups, of the third pair of rollers of a plurality of double-folding drafting units.

The section illustrated in FIG. 5 comprises, for example, 8 folding drafting units which have in each case a driven roller WIII. The driven rollers WIII are divided into two groups of equal size, comprising here in each case 4 driven rollers WIII. The driven rollers WIII of each group are driven by means of a toothed belt 8. The drive torque is introduced via a spur wheel set 9. Division into two groups has the advantage that the stresses acting upon the toothed belt 8 are halved, as compared with only one group. This is advantageous, particularly when a relatively large number of rollers WIII are being driven, because of the considerable forces arising on account of the moments of friction of the aprons RIII, R3 and of the pair of rollers WIII/W3.

In addition to the embodiment, illustrated here, with 8 folding drafting units, any other number of folding drafting units can also be envisaged, for example 6, 10 or 12 folding drafting units.

In order to obtain maximum possible evenness of the fibre material leaving the folding drafting unit, it is advantageous to drive the pairs of rollers WII/W2, WIII/W3 and WIV/W4, delimiting the second drafting zone V2 and the third drafting zone V3 in which the sliver is folded, at as identical a circumferential speed as possible, in order thereby to implement a minimum draft in the folding zones. This can be implemented, for example, with the aid of the drive concepts illustrated in FIGS. 6, 7 and 8. In this case, the driven rollers WII, WIII and WIV of the second pair of rollers WII/W2, of the third pair of rollers WIII/W3 and of the fourth pair of rollers WIV/W4 are driven via a common drive M2, and the driven roller WI of the first pair of rollers WI/W1 and the driven roller WV of the fifth pair of rollers WV/W5 are driven in each case via a dedicated drive M1 and M3 respectively. The separate drives for the driven roller WI of the first pair of rollers WI/W1 and the driven roller WV of the fifth pair of rollers WV/W5 are expedient, since the pairs of rollers WI/W1, WII/W2, WIII/W3, WIV/W4, WV/W5 of the double-folding drafting unit run at different speeds in order to obtain the desired drawing of the fibre material. In order to reduce the number of drives and not have to keep a dedicated motor in reserve for each drafting unit, the drafting units are preferably combined into sections, as already described above, in each case all the mutually corresponding driven rollers of the drafting units of a section being driven in each case by a motor. It is also possible for all the mutually corresponding driven rollers of all the sections to be driven by only one motor.

Figure 6:
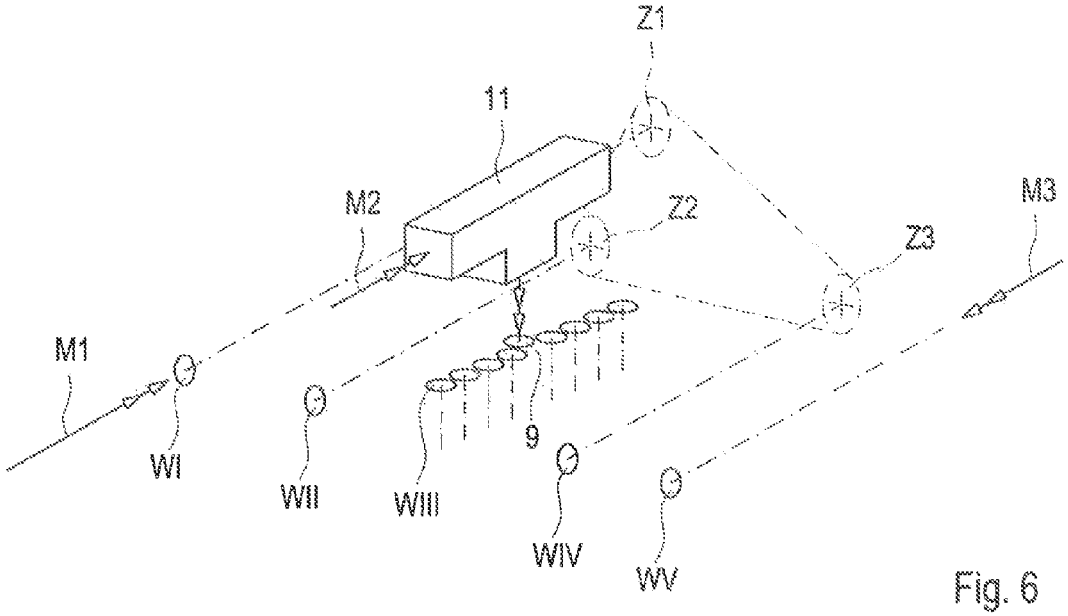
FIG. 6 shows a drive concept for a double-folding drafting unit in an isometric view in a first embodiment.

In the embodiment illustrated in FIG. 6, all the slow-running driven rollers WI of the first pair of rollers WI/W1 of a section are driven by a first motor M1 via a gear stage. The driven rollers WII, WIII, WIV of the second pair of rollers WII/W2, of the third pair of rollers WIII/W3 and of the fourth pair of rollers WIV/W4 are driven via an interposed three-way gear 11. The different rotational speeds of the driven rollers WII and WIV can in this case be generated, for example, by the gearwheels Z1, Z2, Z3 of a toothed-belt gear. The driven roller WIII of the third pair of rollers WIII/W3 is driven, for example, via a free shaft end of the three-way gear 11 and the spur wheel set 9.

The driven roller WV of the fifth pair of rollers WV/W5 is driven by means of a third motor M3.

The number of motors M1, M2, M3 for each section can thereby be restricted to three motors. It is thus possible, for example, to operate the spinning devices of a spin-knitting machine, which contains 48 or 72 workstations distributed to 6 sections, by means of only 18 motors.

Figure 7:
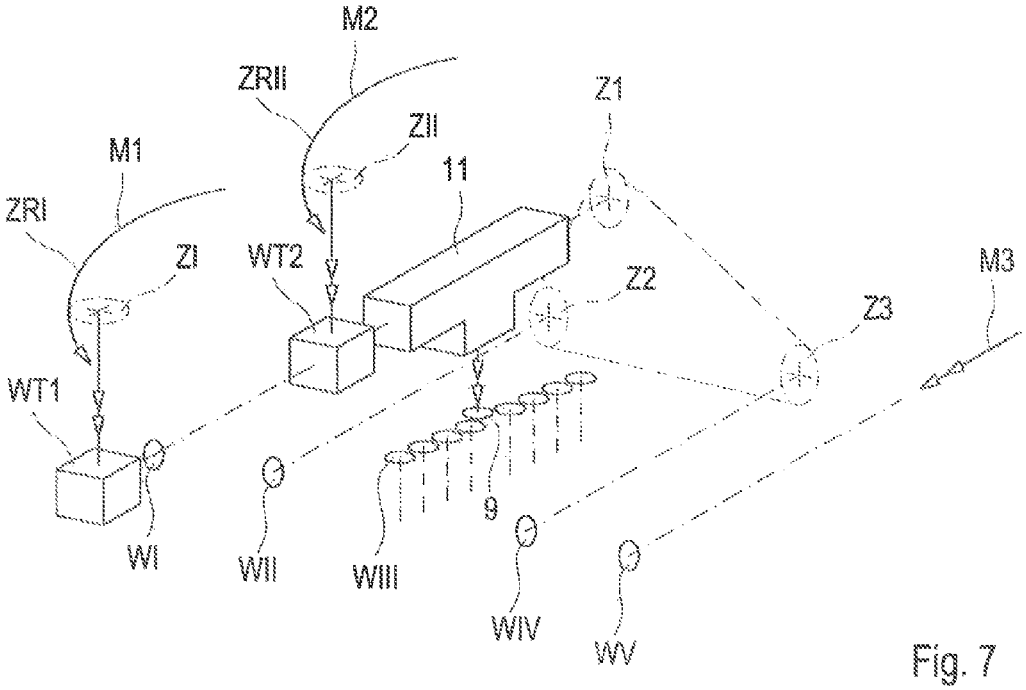
FIG. 7 shows a drive concept for a double-folding drafting unit in an isometric view in a second embodiment.

A further drive concept is illustrated in FIG. 7,

Since servomotors are conventionally used for the drafting units of a spin-knitting machine and these constitute a complicated type of drive, it is advantageous to reduce the number of motors further.

For this purpose, for example, it is possible, as illustrated in FIG. 7, to drive all the driven rollers WI of the first pairs of rollers WI/W1 of all the drafting units of the machine by means of a common motor M1. In this case, it is possible, for example, via gearwheels ZI which are driven by means of a toothed belt ZRI running around the machine and are connected to V-drives WT1, to conduct the drive torque to the driven rollers WI of the first pairs of rollers WI/W1 of a section.

The driven rollers WII, WIII and WIV of the second pairs of rollers WII/W2, of the third pairs of rollers WIII/W3 and of the fourth pairs of rollers WIV/W4 are also driven correspondingly, in that the drive torque is transmitted from a central motor M2 via a toothed belt ZRII to gearwheels ZII and from these, via a V-drive WT2, to the three-way gear 11, in this drive concept, too, as in that illustrated in FIG. 6, the driven rollers WII, WIII, WIV of the second pair of rollers WII/W2, of the third pair of rollers WII/W3 and of the fourth pair of rollers WIV/W4 being connected to the three-way gear 11.

The driven rollers WV of the fifth pairs of rollers WV/W5 are driven by means of a drive for each section, as illustrated in FIG. 6.

Figure 8:
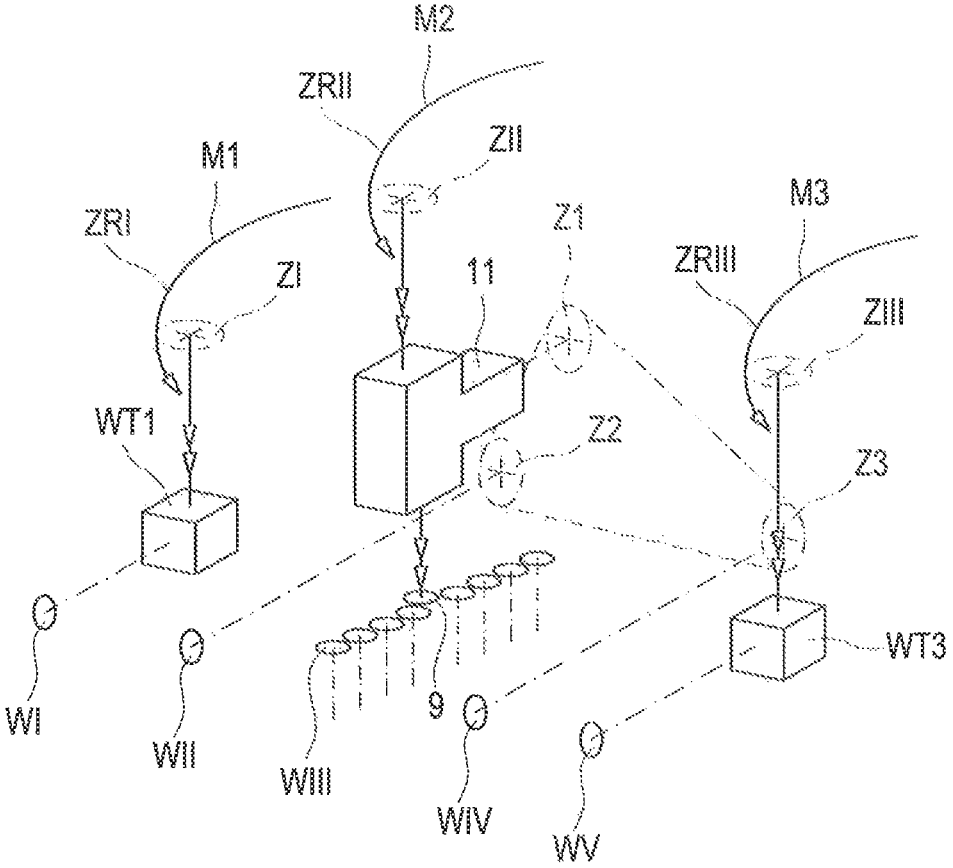
FIG. 8 shows a drive concept for a double-folding drafting unit in an isometric view in a third embodiment.

A third alternative for a suitable drive concept is illustrated in FIG. 8.

In contrast to the embodiment illustrated in FIG. 7, in the embodiment illustrated in FIG. 8 the driven rollers WV of all the fifth pairs of rollers WV/W5 of all the sections of the machine are also driven via a common motor M3, here, too, the drive torque being transmitted to the driven rollers WV of the fifth pair of rollers WV/W5 via a toothed belt ZRIII, a gearwheel ZII and a V-drive WT3.

In order to obtain even quality of the product and even yarn uniformity, the servomotors normally used are suitable to only a limited extent, since servomotors are usually regulated in steps and therefore follow the speed stipulated by a knitting device only to a certain degree which depends on the quality of the regulation. Owing to the very high speed of the fifth pair of rollers WV/W5, even the least regulation-induced deviations in speed lead to unevenness in the fibre stream. The result of this is that the knit produced by means of the corresponding knitting machine has an "irregular" appearance.

An improvement in quality can be achieved if the driven rollers WV of the fifth pairs of rollers WV/W5 are driven by means of a combination of servo drive and reluctance drive.

When the machine is started up, that is to say when the machine is accelerated until the production speed is reached, the driven rollers WV of the fifth pairs of rollers WV/W5 are driven by a servomotor. This, because of its regulation, can adapt the speed of the fifth pairs of rollers WV/W5 to the increase in the production speed. Starting from a specific minimum speed of the machine, a reluctance motor is then cut in synchronously. The servo drive is switched off and the servomotor of the servo drive can corotate in idling mode. During the start-up, even both motors, that is to say the servomotor and reluctance motor, may run jointly. Synchronism with the knitting machine is brought about by the servomotor, while the reluctance motor corotates as an asynchronous machine.

As soon as the knitting machine has reached its production rotational speed, the reluctance motor alone can assume the drive.

The run-down of the machine is also controlled in a similar way. In this case, the servo drive is initially cut in again and, during the run-down, the servomotor assumes the regulation in order to obtain synchronism, while the reluctance motor corotates or else can be switched off. As soon as the knitting machine is stationary, the servomotor is also switched off.

Stabilization of the drafting operation in the fourth drafting zone V4, particularly in the case of maximum drafts in which a draft of 200 to 400 times takes place, can be achieved if the apron R4 assigned to the corotating roller W4 of the fourth pair of rollers WIV/W4 is designed with a minimum thickness. In the case of commercially available aprons used at the present time, this is a thickness of 0.3 to 0.7 mm. If appropriate, a smaller thickness can also be implemented, depending on the material of the apron. For reasons of stability, it may also be necessary, where appropriate, depending on the material, to produce the apron in a greater thickness. However, a thickness in the range of 0.3 to 0.7 mm is preferred.

Figure 9:
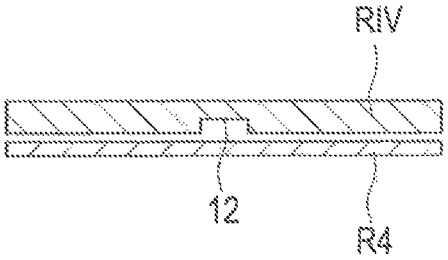
FIG. 9 shows a section through a pair of aprons running around the rollers of the fourth pair of rollers.

The apron RIV guided around the driving roller WIV is produced with a greater thickness, preferably in the range of 0.7 to 1.2 mm. Such a thickness corresponds to the thickness customary for aprons in drafting units. As illustrated in FIG. 9, a depression 12 preferably running in the transport direction of the fibre material is introduced in the apron RIV running around the driving roller WIV. The said depression especially advantageously runs centrally in the apron RIV. The cross section of the depression 12 may assume any form, but a rectangular cross section with a depth of 0.1 to 0.25 mm, for example of 0.25 mm, and with a width of 5 to 10 mm, preferably of 5 mm, is preferred.

Together with the apron R4 running around the corotating roller W4, the fibre-guiding system assumes the nature of a "pulling drafting unit" which is used in long-staple processing, for example in the processing of wool.

The invention claimed is:

1. Double-folding drafting unit, comprising five pairs of rollers a first, a second, a fourth and a fifth pair of rollers having essentially an identical orientation of the respective axes of the rollers, and a third pair of rollers, which is positioned between the second and the fourth pair of rollers, having an axial direction which is oriented perpendicularly to the axial direction of the other pairs of rollers, an apron being guided in each case around each roller of the third pair of rollers and at least one reversing rail assigned to the respective roller, and an apron being guided around each roller of the fourth pair of rollers and around a reversing rail in front of and a reversing rail behind the respective roller.

2. Double-folding drafting unit according to claim 1, characterized in that in each case one roller of a pair of rollers is driven and one roller corotates.

3. Double-folding drafting unit according to claim 1, characterized in that in each case two adjacent pairs of rollers form a drafting zone, a first drafting zone between the first and the second pair of rollers having a draft which is comparable to the draft of a roving machine, a second drafting zone between the second and the third pair of rollers and a third drafting zonebetween the third and the fourth pair of rollers having in each case tensioning drafts, and a main draft being implemented in a fourth drafting zone between the fourth and the fifth pair of rollers.

4. Double-folding drafting unit according to claim 2, characterized in that the corotating rollers of the first, second and fourth pair of rollers lie on a first pressure arm, and a second pressure arm carries the corotating roller of the fifth pair of rollers.

5. Double-folding drafting unit according to claim 2, characterized in that the corotating roller of the third pair of rollers is connected to a torsion shaft via a lever arm.

6. Double-folding drafting unit according to claim 1, characterized in that the aprons of the fourth pair of rollers have a different thickness, the apron which runs around the corotating roller of the fourth pair of rollers having a smaller thickness than the apron running around the driving roller of the fourth pair of rollers.

7. Double-folding drafting unit according to claim 6, characterized in that, in the apron running around the driving roller of the fourth pair of rollers, a depression pointing in the running direction is formed in the surface pointing towards the fibre stream.

8. Double-folding drafting unit according to claim 7, characterized in that the depression is formed centrally in the apron running around the driving roller of the fourth pair of rollers.

9. Double-folding drafting unit according to claim 1, characterized in that an apron is guided in each case around each roller of the first pair of rollers and at least one reversing rail assigned to the respective roller.

10. Double-folding drafting unit according to claim 2, characterized in that the driven rollers of the second, third and fourth pair of rollers are coupled to a common gear, the gear being assigned a motor or a drive train.

11. Spin-knitting machine, comprising at least two double-folding drafting units according to claim 1, the double-folding drafting units being arranged around the spin-knitting machine.

12. Spin-knitting machine according to claim 11, characterized in that the drive of a plurality of driven rollers of in each case corresponding pairs of rollers of the double-folding drafting units comprises two groups which are connected to one another by means of toothed belts, a gear stage coupling the two groups.

13. Spin-knitting machine according to claim 12, characterized in that the drive of the fifth pair of rollers comprises a reluctance drive and a servo drive.

14. Method for starting up and running down a spin-knitting machine according to claim 13, characterized in that, when the spin-knitting machine is being started up, the driving roller of the fifth pair of rollers is initially driven by means of the servo drive, in which case the reluctance drive can corotate or is cut in at a stipulated rotational speed and, after the production rotational speed is reached, the servo drive is switched off and the drive of the driving roller of the fifth pair of rollers takes place via the reluctance drive, and, when the spin-knitting machine is being run down, the servo drive is initially cut in, with reduction in the production rotational speed, the drive of the driving roller of the fifth pair of rollers is assumed by the servo drive and the reluctance drive is switched off.

* * * * *